United States Patent [19]

Caplis et al.

[11] Patent Number: 4,698,926

[45] Date of Patent: Oct. 13, 1987

[54] HYDRAULIC EXCAVATOR AND COMPACTOR BUCKET THEREFOR

[75] Inventors: Thomas J. Caplis; John Zbitnoff, both of Missoula, Mont.

[73] Assignee: Felco Industries, Ltd., Missoula, Mont.

[21] Appl. No.: 866,122

[22] Filed: May 22, 1986

[51] Int. Cl.[4] ..... E02F 3/76; E01C 19/34

[52] U.S. Cl. ..... 37/197; 37/117.5; 37/DIG. 18; 37/103; 404/133; 404/72

[58] Field of Search ..... 37/117.5, 103, DIG. 18, 37/197; 404/117, 127–128, 121, 133, 72; 414/724; 299/14

[56] References Cited

U.S. PATENT DOCUMENTS

| | | | |
|---|---|---|---|
| 3,427,939 | 2/1969 | Braff et al. | 404/133 |
| 3,592,111 | 7/1971 | Livingston et al. | 404/133 |
| 3,749,506 | 7/1973 | Lance | 404/133 |
| 3,909,149 | 9/1975 | Century | 404/133 |
| 3,917,426 | 11/1975 | Wohlwend et al. | 404/133 |
| 4,224,003 | 9/1980 | St. Louis | 404/133 |
| 4,278,368 | 7/1981 | Livesay | 37/117.5 |
| 4,280,770 | 7/1981 | Woodruff | 404/133 |
| 4,382,715 | 5/1983 | Vural et al. | 404/133 |
| 4,417,628 | 11/1983 | Gessner | 37/117.5 |
| 4,439,057 | 3/1984 | Sprague | 404/133 |

FOREIGN PATENT DOCUMENTS

| | | | |
|---|---|---|---|
| 170333 | 9/1984 | Japan | 37/117.5 |
| 1328794 | 9/1973 | United Kingdom | 37/117.5 |

*Primary Examiner*—E. H. Eickholt

*Attorney, Agent, or Firm*—Seed and Berry

[57] ABSTRACT

A hydraulic bucket-compactor assembly for a backhoe is disclosed which enables the operator of the backhoe to place and compact material with the backhoe eliminating the need for an extra piece of equipment for compaction. The bucket-compactor is attached to the dipper stick of the backhoe, and is controlled from the cab of the backhoe. A vibrating compactor has its drive unit positioned within the bucket and a leg extending from the drive unit through an opening in the bucket heel wall. A compactor is attached to the leg exterior of the bucket.

13 Claims, 4 Drawing Figures

FIG. 1
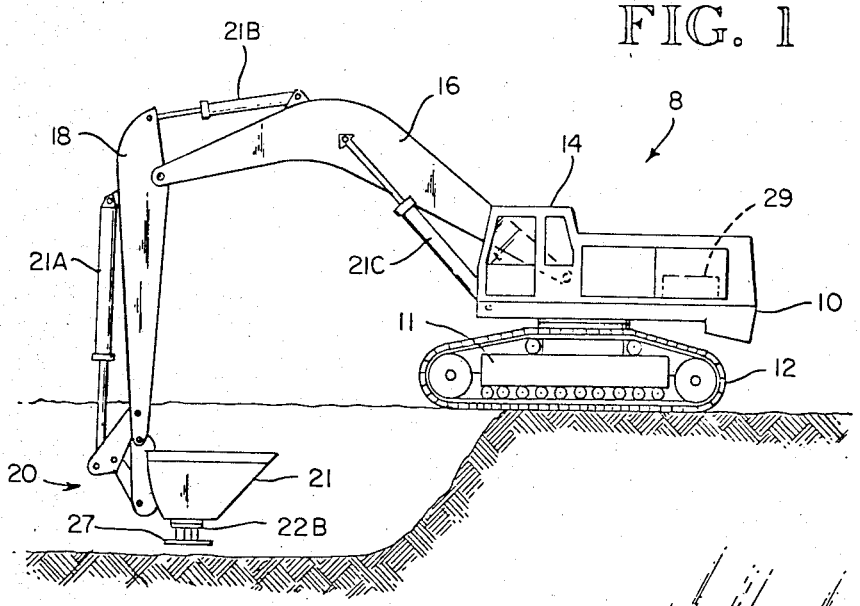
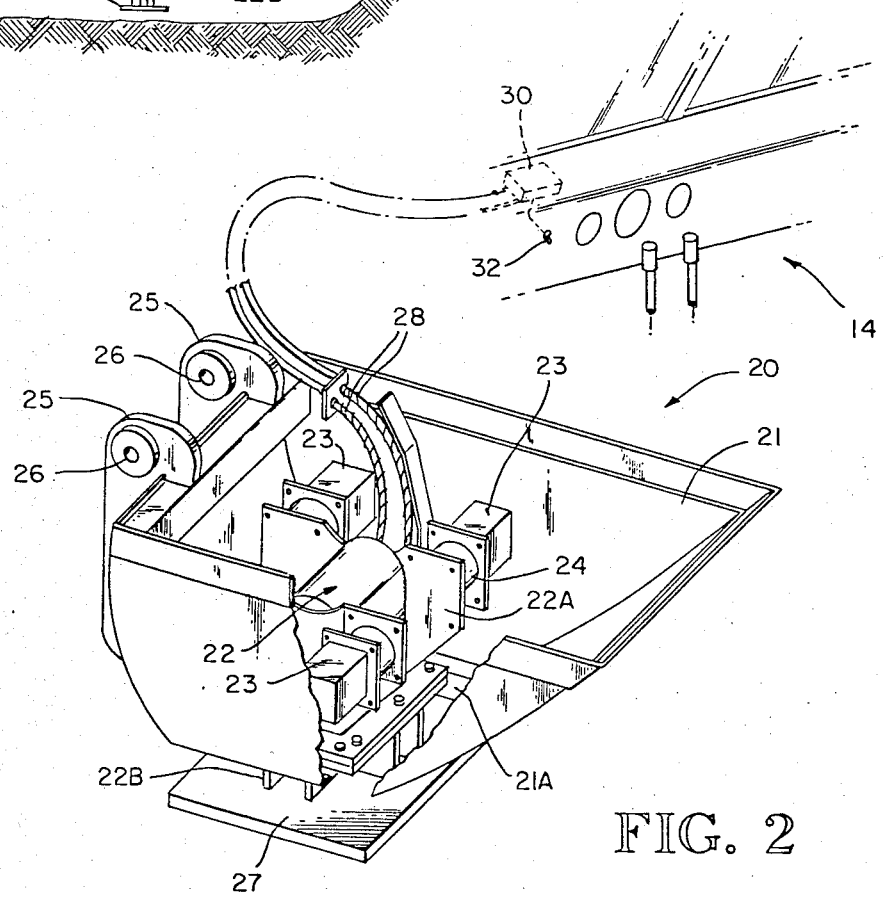
FIG. 2

HYDRAULIC EXCAVATOR AND COMPACTOR BUCKET THEREFOR

TECHNICAL FIELD

This invention relates to hydraulic excavators and more particularly, to a hydraulic excavator which can both place and compact soil.

BACKGROUND OF THE INVENTION

It is generally necessary to compact soils in layers after pipe has been laid in trenches and other excavations. Compaction in trenches and excavation has generally been accomplished by one type of machine, such as a backhoe, placing the material and another separate machine compacting it. This is not only inefficient, but in many cases very difficult because of the limited amount of access room around many of the trenches and excavations.

DISCLOSURE OF THE INVENTION

The present invention is an excavator which includes an undercarriage, a base frame rotatably mounted on the undercarriage, and first and second articulated arms. The first arm is pivotally secured by one end to the base and pivotally supports by its remote end one end of the second arm. The invention includes a bucket secured to a remote end of the second arm with the bucket having an opening in its one wall. A compactor is provided having a drive unit positioned within the bucket and a leg extending from the drive unit through the opening in the bucket wall. The leg has a compactor pad attached thereto exterior of the bucket. In a presently preferred embodiment of the invention, the opening is provided in the heel wall of the bucket. The bucket of the present invention may loosely deposit material contained within the bucket and then be positioned for the pad of the compactor to compact the deposited material without requiring use of a separate compactor machine.

The compactor drive unit is supported within the bucket by two pair of supports rigidly attached to the opposing lateral sidewalls of the bucket and projecting inward. The drive unit is positioned between the supports with a shock mount positioned between each support and the drive unit.

The base frame includes hydraulic pumps to provide hydraulic fluid to operatively position the articulated arms and the bucket, and to drive the compactor. The excavator includes a cab mounted on the base frame and controls positioned therein for remote operation of the compactor from within the cab. The compactor-bucket of the present invention may be pivotally attached to an excavator of conventional design, such as a backhoe.

The invention includes a method of using the excavator by placing it adjacent to the area selected where material is to be placed and compacted, controlling the excavator articulated arms and bucket to at least partially fill the bucket with material to be deposited on the selected area, and controlling the excavator articulate arms and bucket to deposit the material in the bucket onto the selected area. The bucket is then pivoted to position the compactor pad below the bucket, and the compactor is activated for operation. The articulated arms are controlled to engage the operating compactor pad with the material deposited onto the selected area for compacting the material to a desired density. As such, the placement and compacting of the material is accomplished with a single unit by a single operator without requiring an excavator for material placement and movement of the excavator to allow a separate compactor machine to be brought in by another operator for compacting the material.

Other features and advantages of the invention will become apparent from the following detailed description, taken in conjunction with the accompanying drawings.

BRIEF DESCRIPTION OF THE DRAWINGS

FIG. 1 is a side elevational view of a backhoe of the present invention with a compactor-bucket for placing and compacting material on command of the operator.

FIG. 2 is a reduced scale fragmentary, perspective view of the compactor-bucket assembly apart from the backhoe of FIG. 1 with the hydraulic lines shown schematically connected to a main control valve and an operator actuated toggle switch positioned in the cab.

BEST MODE FOR CARRYING OUT THE INVENTION

Figure 3:
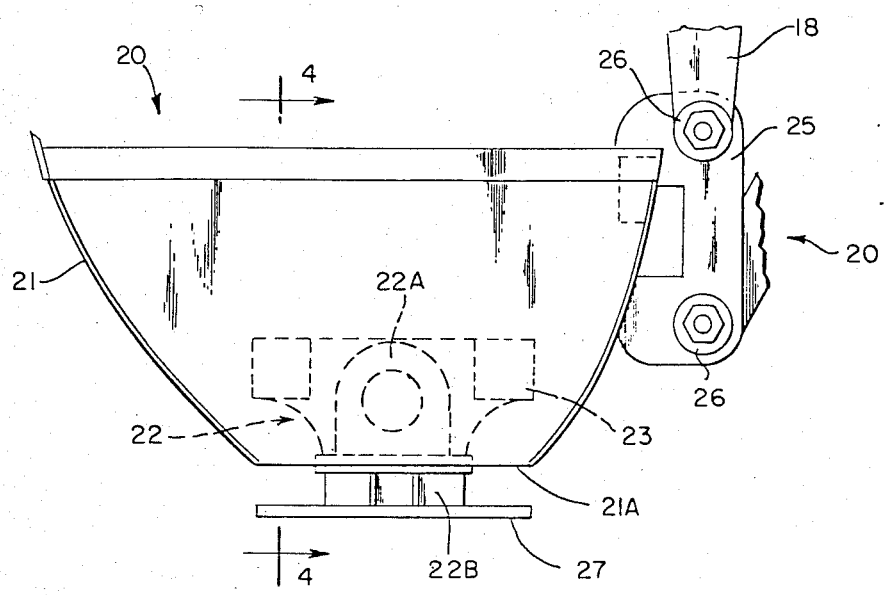
FIG. 3 is a side elevational view of the compactor-bucket assembly of FIG. 2.

FIG. 1 illustrates a conventional hydraulic excavator or backhoe 8 which includes the present invention. The backhoe has a rotatable support frame 10 mounted to an undercarriage 11 to which crawler tracks 12 are attached for mobility. A cab 14 is supported on the frame 10. A pair of articulating arms 16 and 18 extend from a pivotal connection to the support frame. A compactor-bucket, indicated generally by reference numeral 20, is pivotally secured to the remote end of arm 18, as illustrated. Movement of the compactor bucket 20 and positioning of the articulating arms is controlled by hydraulic cylinders 21A, 21B and 21C.

Referring to FIG. 2, the compactor-bucket 20 includes a steel walled bucket 21 and a vibrating compaction unit 22. The compaction unit includes a drive unit portion 22A positioned within the bucket and a leg portion 22B which extends downward through an opening 21A in the heel or bottom wall of the bucket. A steel foot pad 27 is bolted to the leg portion of the compaction unit and positioned below and external to the bucket 21. The drive unit portion and opening are sized such that the drive unit portion substantially blocks the opening to limit the amount of material which passes therethrough when the bucket is picking up and carrying material.

Figure 4:
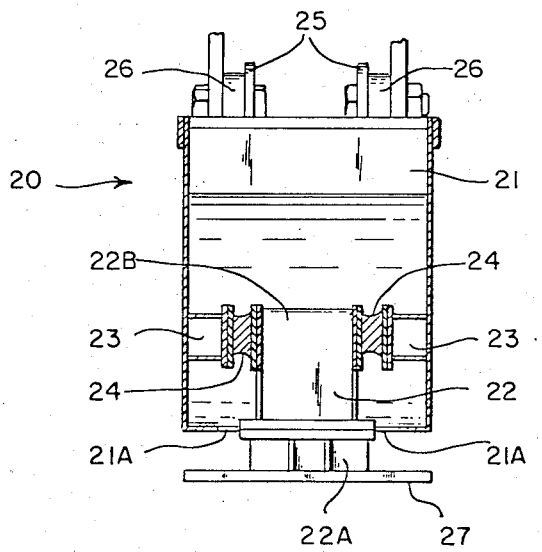
FIG. 4 is a vertical cross sectional view along the line 4—4 of FIG. 3 illustrating the shock mounts of the compactor-bucket assembly.

As illustrated in FIGS. 2, 3 and 4, four tubular steel braces 23 are welded to the interior of the bucket 21, two on each side of the bucket, to support the compaction unit 22. Rubber shock mounts 24 are bolted between the compaction unit and the steel braces.

Steel eyes 25 are welded to the exterior of the bucket 21 and extend rearwardly. Steel or steel and rubber bushings 26 are welded to the eyes for securing the bucket to the arm 18 of the backhoe.

Hoses and tubes 28 are used to transfer the hydraulic oil from the main backhoe pumps 29 to the motor of the drive unit portion 22A of the vibrating compaction unit 22. These hoses and tubes are attached to the articulating arms of the backhoe by a clamping system as necessary. Upstream from the hoses and tubes a main control valve, shown schematically by reference numeral 30 in FIG. 2, is installed on the backhoe. This control valve can be either a manual or remote type whichever is preferred by the operator of the backhoe. A control mechanism, such as an electronic on/off toggle switch 32, is provided in the cab of the backhoe to allow the operator of the backhoe to operate the main control valve and thereby start and stop the compaction unit on command.

In operation, the backhoe 8 using the compactor bucket 20 is used for both placing and compacting soil or other material with the backhoe without having to use another support piece of equipment. The bucket compactor is attached to the end of one of the articulated arms or dipper stick of the backhoe and enables the single piece of equipment to perform two functions. The backhoe can pick up and place the soil in the desired location and then compact it to the required density. The bucket compactor is controlled by the operator of the backhoe enabling a single operator to both place and compact the soil. Use of a backhoe of the present invention often enables faster operations, eliminates the need for an additional piece of equipment and operator to place the soil prior to compaction, and greatly reduces congestion in work areas with limited access.

It will be appreciated that although specific embodiments of the invention have been described herein for purposes of illustration, various modifications may be made without departing from the spirit and scope of the invention. Accordingly, the invention is not limited except by the appended claims.

What is claimed is:

1. A method of placing and compacting material with an excavator having a pair of articulated arms, with one arm having a bucket pivotally secured thereto, the bucket having an opening in a wall thereof and supporting a compactor, the compactor having a drive unit positioned within the bucket and a leg extending from the drive unit through the opening with a pad attached thereto exterior of the bucket, comprising:

positioning the excavator adjacent to the area selected where the material is to be place and compacted;

controlling the excavator articulated arms and bucket to at least partially filling the bucket with material to be deposited in the selected area;

controlling the excavator articulated arms and bucket to deposit the material in the bucket in the selected area;

pivoting the bucket to position the compactor pad below the bucket;

activating operation of the compactor; and controlling the excavator articulated arms to engage the operating compactor pad with the material deposited in the selected area for compacting the material to a desired density, whereby the placement and compacting of the material is accomplished with a single unit by a single operator without requiring an excavator for material placement and movement of the excavator to allow a separate compactor machine to be brought in by another operator for compacting the material.

2. An excavator, comprising:

an undercarriage;

a base frame rotatably mounted on said undercarriage;

first and second articulated arms, said first arm being pivotally secured by one end to said base and pivotally supporting by its remote end one end of said second arm;

a bucket pivotally secured to a remote end of said second arm, said bucket having an opening in a heel wall of the bucket; and a compactor having its drive unit positioned within said bucket and a leg extending from said drive unit through said opening, said leg having a compactor pad attached thereto exterior of said bucket, whereby said bucket may pick up and loosely deposit material contained within said bucket and then be positioned for said pad of said compactor to compact the deposited material without requiring use of a separate compactor machine.

3. The excavator of claim 1 wherein said compactor drive unit is supported within said bucket by two pair of supports rigidly attached to the opposing lateral sides of said bucket and projecting inward, said drive unit being positioned between said supports.

4. The excavator of claim 2 wherein each of said supports has a shock mount positioned between said support and said drive unit.

5. The excavator of claim 1 wherein said base frame includes hydraulic pumps to provide hydraulic fluid to operatively position said articulated arms and said bucket, and to drive said compactor.

6. The excavator of claim 2 further including a cab mounted on said base frame and controls positioned in said cab for remote operation of said compactor from within said cab.

7. A compactor-bucket attachable to the articulated arms of an excavator, comprising:

a bucket pivotably securable to an end of one of the articulated arms of the excavator, said bucket having an opening in a wall thereof; and a compactor having its drive unit within said bucket and a leg extending from said drive unit through said wall opening, said leg having a compactor pad attached thereto exterior of said bucket.

8. The compactor-bucket of claim 7 wherein said opening is in a heel wall of said bucket.

9. The excavator of claim 7 wherein said compactor drive unit is supported within said bucket by two pair of supports rigidly attached to the opposing lateral sides of said bucket and projecting inward, said drive unit being positioned between said supports.

10. The excavator of claim 9 wherein each of said supports has a shock mount positioned between said support and said drive unit.

11. An excavator, comprising:

an undercarriage;

a base frame rotatably mounted on said undercarriage;

first and second articulated arms, said first arm being pivotally secured by one end to said base and pivotally supporting by its remote end one end of said second arm;

a bucket pivotally secured to a remote end of said second arm, said bucket having a digging lip; and a compactor supportedly connected to said bucket and having a drive unit and a compactor pad attached to said drive unit;

support means for supportedly connecting said compactor to said bucket with said drive unit and pad positioned relative to said bucket to permit use of said digging lip for digging and said bucket for receiving material substantially simultaneously as dug using said digging lip, and to permit deposit of the received material into the bottom of a trench or other excavation by pivoting said bucket to dump the received material over said digging lip, said support means supporting said compactor with said pad positioned exterior of said bucket to permit said bucket to be pivoted to position said pad therebelow during operation of said compactor.

12. An excavator, comprising:

an undercarriage;

a base frame rotatably mounted on said undercarriage;

first and second articulated arms, said first arm being pivotally secured by one end to said base and pivotally supporting by its remote end one end of said second arm;

a bucket pivotally secured to a remote end of said second arm, said bucket having an opening in one wall thereof; and a compactor supportedly connected to said bucket and having a drive unit and a compactor pad attached to said drive unit by a leg extending through said opening, said drive unit and pad being positioned within said bucket to permit said bucket to receive material and deposit the received material into the bottom of a trench or other excavation, and said pad being positioned exterior of said bucket to permit said bucket to be pivoted to position said pad therebelow during operation of said compactor.

13. The excavator of claim 12 wherein said opening is located in a heel wall of said bucket.

* * * * *

UNITED STATES PATENT AND TRADEMARK OFFICE

CERTIFICATE OF CORRECTION

PATENT NO. : 4,698,926

DATED : October 13, 1987

INVENTOR(S) : Thomas J. Caplis et al

It is certified that error appears in the above-identified patent and that said Letters Patent is hereby corrected as shown below:

In the Claims:

Claim 1, column 3, line 44, change the word "place" to --placed--.

Claim 1, column 3, line 47, change "filling" to --fill--.

Claim 3, column 4, line 17, change "1" to --2--.

Claim 4, column 4, line 22, change "2" to --3--.

Claim 5, column 4, line 25, change "1" to --2--.

Signed and Sealed this

Twenty-sixth Day of July, 1988

*Attest:*

DONALD J. QUIGG

*Attesting Officer*

*Commissioner of Patents and Trademarks*